US005746456A

United States Patent [19]

Violi et al.

[11] Patent Number: 5,746,456

[45] Date of Patent: May 5, 1998

[54] OVEN DOOR LOCKING DEVICE

[75] Inventors: Raymond Violi, Marlens; Jean-Francois Ferbus, Seythenex, both of France

[73] Assignee: Societe Cooperative de Production Bourgeois, Faverges, France

[21] Appl. No.: 726,610

[22] Filed: Oct. 7, 1996

Related U.S. Application Data

[63] Continuation-in-part of Ser. No. 307,246, Sep. 16, 1994, abandoned.

[30] Foreign Application Priority Data

Sep. 17, 1993 [FR] France ..... 93 11247

[51] Int. Cl.[6] ..... E05C 1/04

[52] U.S. Cl. ..... 292/146; 292/DIG. 69

[58] Field of Search ..... 292/146, 150, 292/341.16, DIG. 4, DIG. 12, DIG. 37, DIG. 69

[56] References Cited

U.S. PATENT DOCUMENTS

| | | |
|---|---|---|
| 2,446,113 | 7/1948 | Spiller . |
| 2,631,872 | 3/1953 | Wurmser . |
| 2,690,918 | 10/1954 | Holte . |
| 2,837,370 | 6/1958 | Stott et al. . |
| 2,923,562 | 2/1960 | Bagnell et al. . |
| 3,172,675 | 3/1965 | Gonzalez . |
| 3,468,169 | 9/1969 | Welch . |
| 3,576,340 | 4/1971 | Jones et al. . |
| 4,000,917 | 1/1977 | Poehlmann . |
| 4,208,837 | 6/1980 | Black, Sr. et al. . |
| 4,225,004 | 9/1980 | Lipshield . |
| 4,355,830 | 10/1982 | Rau, III . |
| 4,438,962 | 3/1984 | Soloviff et al. . |
| 4,906,123 | 3/1990 | Weskamp et al. . |
| 4,988,132 | 1/1991 | Rocchitelli . |
| 5,012,794 | 5/1991 | Faurel . |

FOREIGN PATENT DOCUMENTS

| | | |
|---|---|---|
| 2025598 | 9/1970 | France . |
| 2653212 | 4/1991 | France . |
| 4134201 | 11/1992 | Germany . |
| 292941 | 7/1965 | Netherlands . |

*Primary Examiner*—Steven N. Meyers
*Assistant Examiner*—Gary Estremsky
*Attorney, Agent, or Firm*—Ratner & Prestia

[57] ABSTRACT

An oven door locking device includes a male rod fixed to the door and entering a female member fixed to the oven muffle. The female member includes locking members movable radially to engage in an intermediate groove on the male rod when the door is closed. The oven is unlocked by operating a push-button which pushes an internal bearing ring against an unlocking ring which withdraws the locking members from the internal bore of the female member in order to remove them from the groove in the male rod.

9 Claims, 8 Drawing Sheets

OVEN DOOR LOCKING DEVICE

This patent application is a continuation-in-part application of parent application Ser. No. 08/307,246 filed on Sep. 16, 1994 now abandoned.

FIELD OF THE INVENTION

The present invention concerns devices for holding and locking an oven door closed and releasing it by operating a control device.

BACKGROUND OF THE INVENTION

Oven door locks usually comprise a hook either on the door or on the muffle of the oven and inter-engaging with a fixed member on the other part.

Document FR-A-2 639 096 describes a device of this kind.

Satisfactory in the usual situation, a prior art structure of this kind proves to be relatively costly, especially in the case of automatic control means for devices inside the oven controlled by locking the door. Also, these devices make no provision for the passage of fluids from the inside of the oven muffle to the inside of the door.

Document FR-A-2 653 212 describes an oven door locking structure in which a male rod projects perpendicularly from the contact side of the door and a female housing is provided in the oven muffle. The male rod and the female housing are shaped and disposed so that the male rod enters the female housing when the door is pressed against the opening of the muffle to close it. The male rod includes an annular groove. The female housing includes an elastic pin whose branches are transversely disposed and engage in the groove on the male rod to lock it in the closed position. Locking and unlocking are effected simply by pushing on or pulling on the door. Consequently, this type of locking is insufficient for use in a steam oven, where the oven enclosure can contain steam under pressure.

The problem to which the present invention is addressed is that of designing a new locking device structure which combines greater reliability, lower manufacturing cost, the facility for simple control of units inside the oven and compatibility with the facility to transmit fluids from the interior of the oven muffle to the interior of the door. Additionally, this new structure must be easy to unlock and compatible with means for applying traction to the oven door to strengthen its closure after it is locked.

SUMMARY OF THE INVENTION

To this end, in accordance with the invention, the device for locking an oven door whose contact side is pressed against a contact side of an oven muffle, is such that:

- a male rod projects perpendicularly from the contact side of the first of the two members comprising the door and the muffle,
- a female member is fitted to the second of the two members comprising the door and the muffle,
- the male rod and the female member are shaped and disposed so that the male rod enters the female member when the door is pressed against the opening of the muffle to close it,
- the male rod includes at least one intermediate annular groove,
- the female member includes locking members movable radially between a locking position in which they enter the internal bore and into the groove of the male rod to prevent axial sliding of the male rod and an unlocking position in which they are withdrawn from the internal bore and from the groove to allow axial sliding of the male rod,
- the female member includes an unlocking ring sliding axially on it and shaped to move the locking members radially between their locking position and their unlocking position when it is moved axially,
- spring means urge the unlocking ring towards its locking position in which the locking members are in their locking position, and
- a push-button is provided on the first of the two members comprising the door and the muffle and is shaped to move the unlocking ring in translation on the female member to bring about unlocking.

In one embodiment of the invention the male rod is fixed to the oven door and the push-button is slidably mounted on the oven door.

In an advantageous embodiment of the invention the male rod and the female member have an axial bore through them connected to respective pipes to allow fluid to flow between the muffle and the oven door.

In an advantageous embodiment of the invention the female member comprises auxiliary locking means adapted to be elastically engaged in the groove when the rod is in an intermediate pre-opening position in which the door is slightly open and retained by the auxiliary locking means engaged in the groove. The door can then be opened by deliberately pulling on the door to extract the auxiliary locking means from the groove.

Other objects, features and advantages of the present invention emerge from the following description of specific embodiments of the invention given with reference to the appended drawings.

DETAILED DESCRIPTION OF THE PREFERRED EMBODIMENTS

Figure 1:
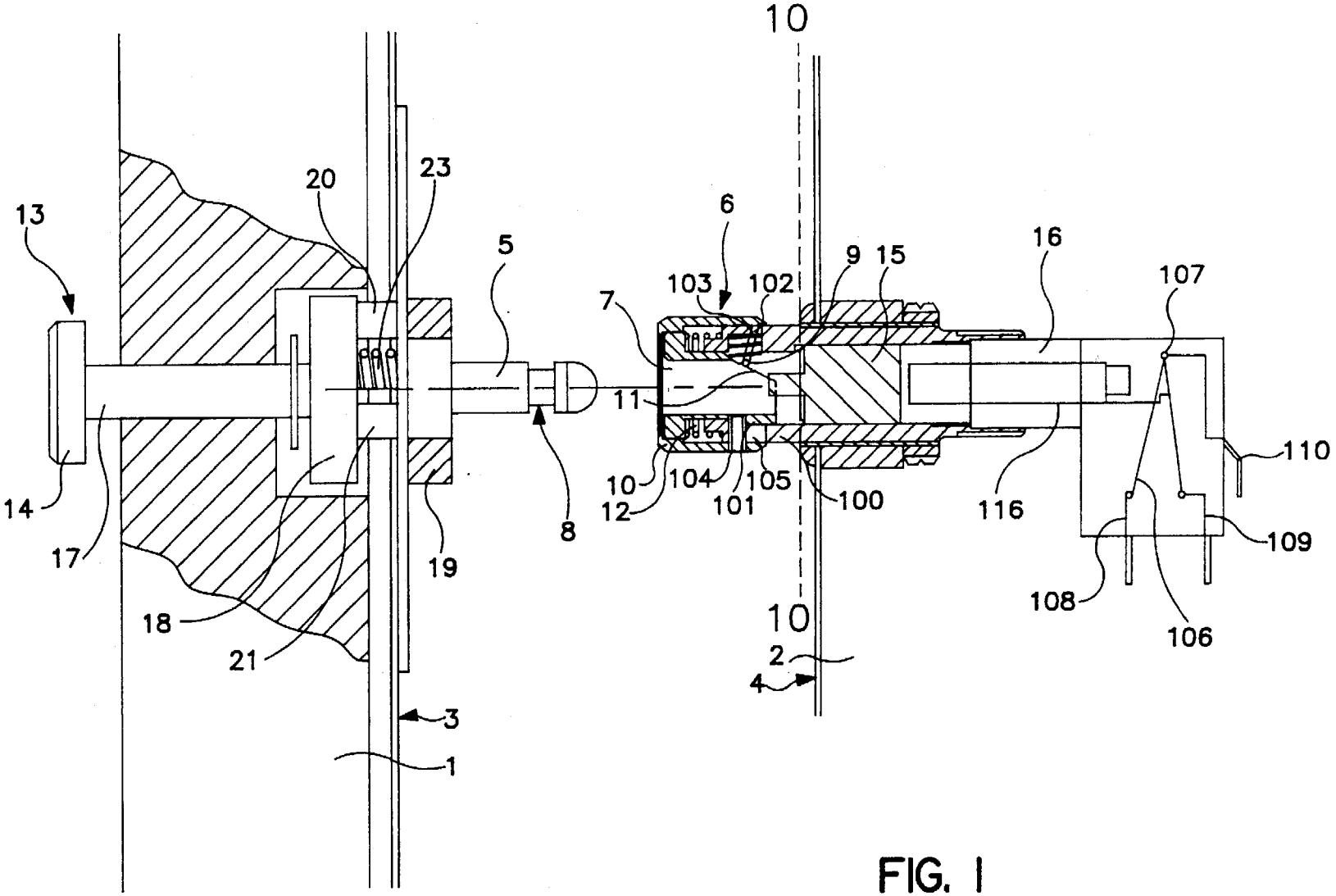
FIG. 1 is a side view in longitudinal cross-section of one embodiment of a locking device in accordance with the invention fitted to an oven door and an oven muffle, the device being shown in an open position.

In the embodiments shown in the figures, the locking device of the invention locks an oven door 1 against an oven muffle 2, with the contact side 3 of the door 1 pressing on a contact side 4 of the muffle 2.

The locking device comprises a male rod 5 which projects perpendicularly from the contact side of the first of the two members comprising the door 1 and the muffle 2. In the embodiments shown, the male rod 5 projects from the contact side 3 of the door 1 to which it is fastened.

A female member 6 is fitted to the second of the two members comprising the door 1 and the muffle 2. Accordingly, in the embodiments shown, the female member 6 is fitted to the muffle 2.

The male rod 5 can be on the muffle 2 and the female member 6 can be on the door 1 without departing from the scope of the present invention.

The male rod 5 and the female member 6 are shaped and positioned so that the male rod 5 enters the female member 6 when the door 1 is pressed against the opening of the muffle 2 to close it. To this end, the female member 6 includes an internal bore 7 in which the male rod 5 can slide.

The male rod 5 includes at least one intermediate annular groove 8 with steep sides and has a rectangular cross-section, for example.

Figure 2:
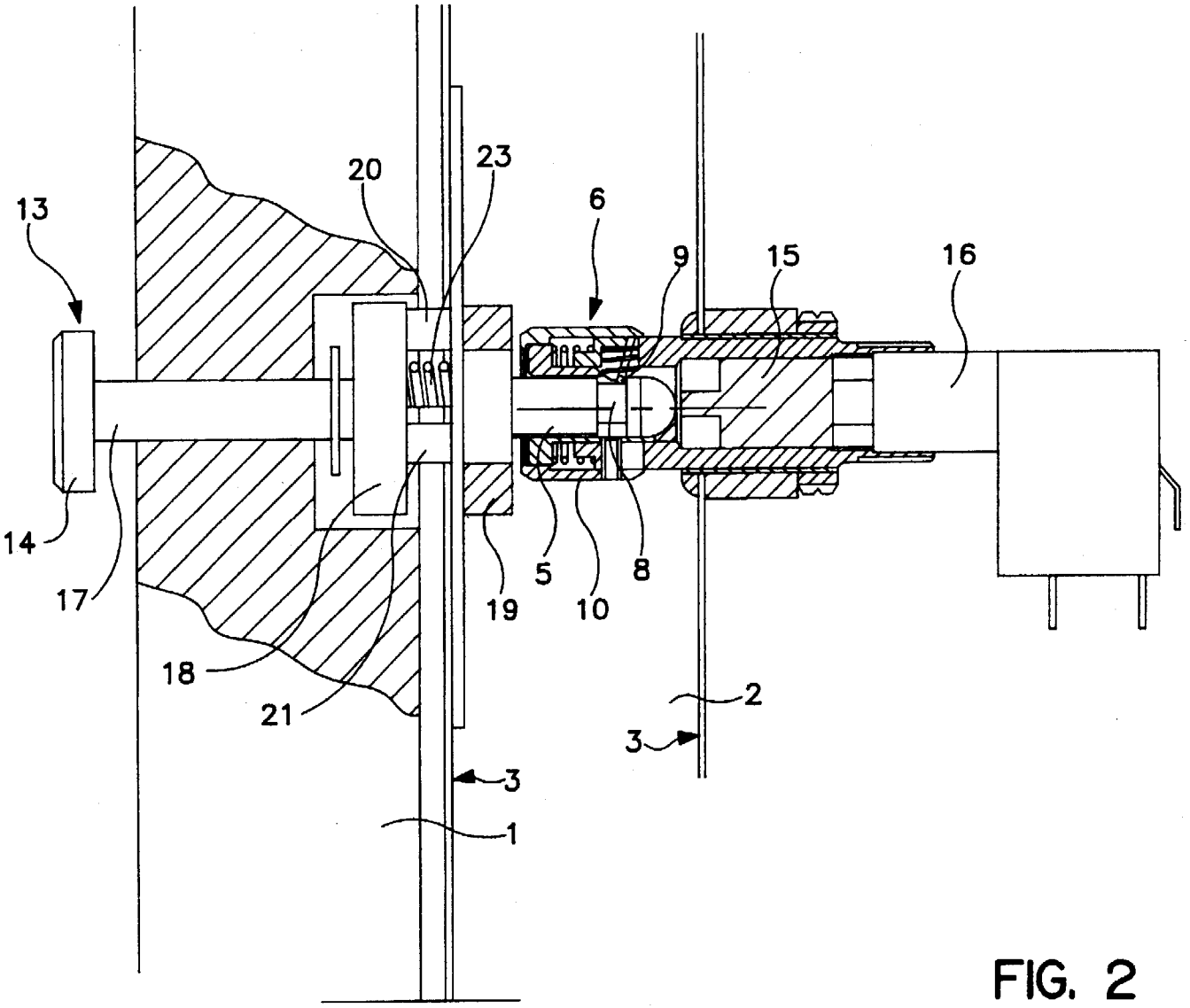
FIG. 2 is a side view in longitudinal cross-section of the device from FIG. 1 in a locked position.

The female member 6 includes locking members 9 that are movable radially between a locking position as shown in FIGS. 1 and 2 in which they can enter the groove 8 to prevent axial sliding of the male rod 5 and an unlocking position in which they are withdrawn from the groove 8 and from the internal bore 7 to allow axial sliding of the male rod 5. The locking members 9 are spring-loaded towards their locking position.

The female member 6 includes an unlocking ring 10 which slides axially on the female member 6 and which is shaped to displace the locking members 9 radially between their locking position and their unlocking position when it moves axially. For example, the unlocking ring 10 can be fastened to a ramp 11 which bears against one part of the locking members 9 to withdraw them from the internal bore 7 when the ring 10 is moved away from the male rod 5.

Spring means such as a compression spring 12 urge the unlocking ring 10 towards its locking position in which the locking members 9 are in their locking position.

A push-button 13 is fitted to the first of the two members comprising the door 1 and muffle 2. In the embodiments shown, the push-button 13 is on the door 1. It is shaped to move in axial translation and to displace the unlocking ring 10 in translation on the female member 6 to bring about unlocking.

In the embodiments shown, the male rod 5 is fixed to the oven door 1 and the push-button 13 is slidably mounted on the oven door. It can be actuated directly by pressing a head 14.

In the embodiment shown, the push-button 13 comprises a head 14 joined by a rod 17 to a bearing plate 18. The bearing plate 18 is joined to an internal thrust ring 19 by three columns slidably mounted in the oven door 1 around the male rod 5. Two columns 20 and 21 are shown. The internal thrust ring 19 bears on the unlocking ring 10. A spring 23 urges the push-button 13 away from the unlocking ring 10.

In the figures, the female member 6 comprises a core 15 sliding freely in the internal bore 7 and adapted to be pushed by the male rod 5 against an electrical switch device 16 to close an electrical contact controlling unit inside the oven when the male rod 5 reaches the locking position as shown in FIG. 2. The electrical switch device 16 operates as follows. A sliding longitudinal rod 116 contacts a flexible metal plate 106 which pivots around an axis 107 for making contact with either a first terminal 108 or a second terminal 109 for electrically connecting terminals 108 or 109 to a third terminal 110. The flexible plate 106 is pushed by the longitudinal rod 116 which is pushed itself by the core 15.

One of ordinary skill in the art would know how to control the "supply of power" to the motor with the switch 16. Thus, this supply of power is not shown in the drawings.

In the embodiment of FIGS. 1 and 2, the female member 6 is fixed to the muffle 2. The locking and unlocking of the device of the invention is described with reference to FIGS. 1 and 2. To lock the device, the push-button 13 is depressed. This forces the internal thrust ring 19 of the male rod 5 to push the unlocking ring 10. When the unlocking ring 10 moves away from the male rod 5, the unlocking ring 10 moves an inner cylindrical piece 101 of the unlocking ring 10 towards the right side of FIG. 1. The inner piece 101 slides in a cylindrical outer casing 100 of the female member 6. The inner piece 101, along with the ramp 11, pushes the locking member (rod) 9 radially towards the outside and towards the right side. The locking member 9 slides against the ramp 11 and along the inclined slot 102 in the peripheral wall of the outer casing so that it withdraws from the internal bore 7. When the unlocking ring 10 is released, a compression spring 103 pushes the locking member 9 towards the internal bore 7 and into the annular groove 8 of the male rod 5 as shown in FIG. 2 by sliding against the ramp 11 and in the slot 102.

The device is unlocked in a similar manner. The push-button 13 is depressed, thereby pushing the unlocking ring 10 and the inner piece 101. This in turn forces the locking member 9 to move from its locked position in the annular groove 8 up the ramp 11 and into the slot 102, even when the head of the male rod 5 pulls the locking member adversely. The male rod 5 is then extracted from the female member 6, and the locking member 9 relaxes back out of the slot 102 into the internal bore 7.

FIG. 1 shows the unlocking ring 10 connected to the inner piece 101. A radial pin 104 joins the ring 10 and the inner piece 101 through a longitudinal elongated hole 105 in the outer casing 100. The elongated hole 105 allows the pin 104 to translate longitudinally with the ring 10 and the inner piece 101.

Figure 3:
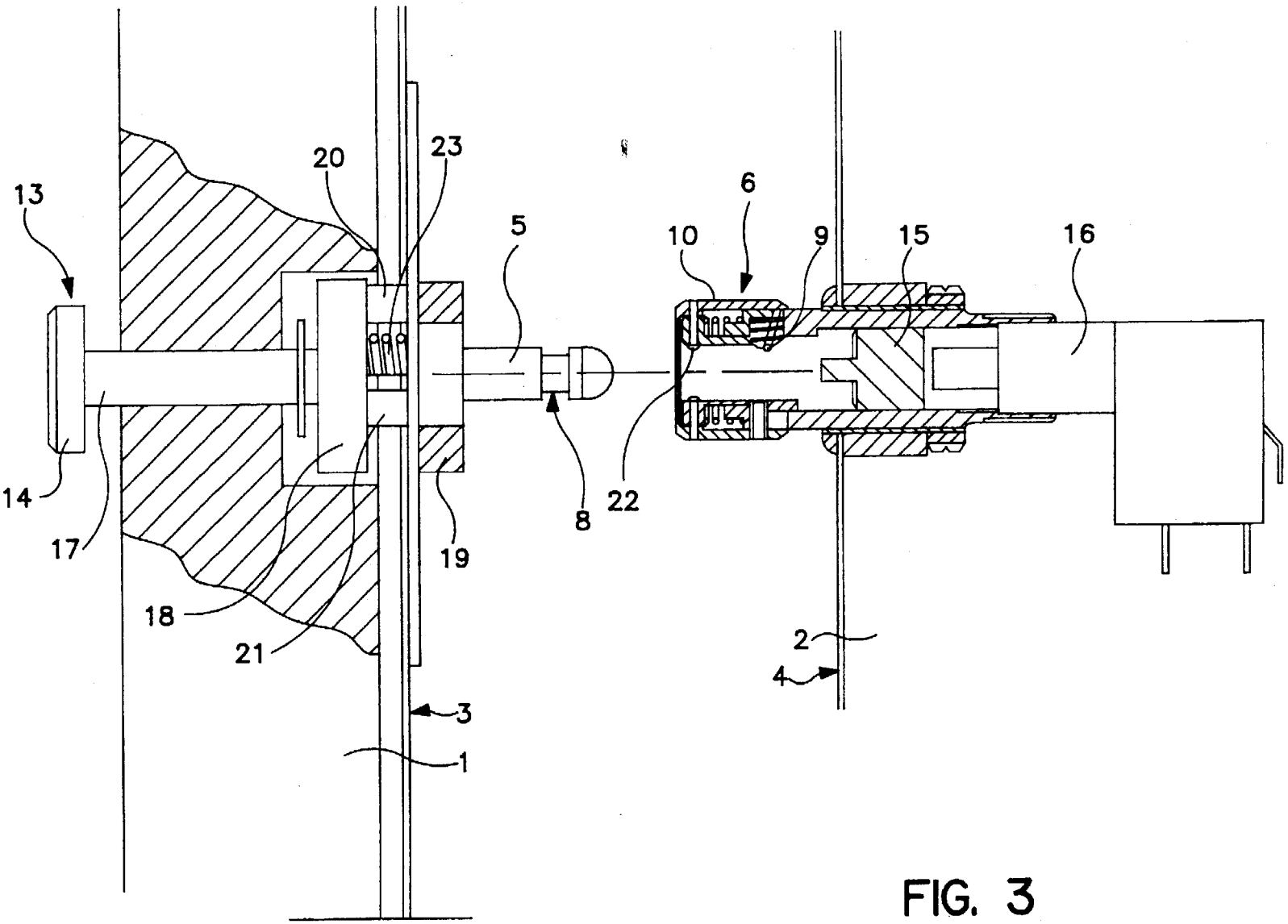
FIG. 3 is a side view in longitudinal cross-section of a second embodiment of a locking device in accordance with the invention, shown in an open position and including auxiliary locking means.
Figure 4:
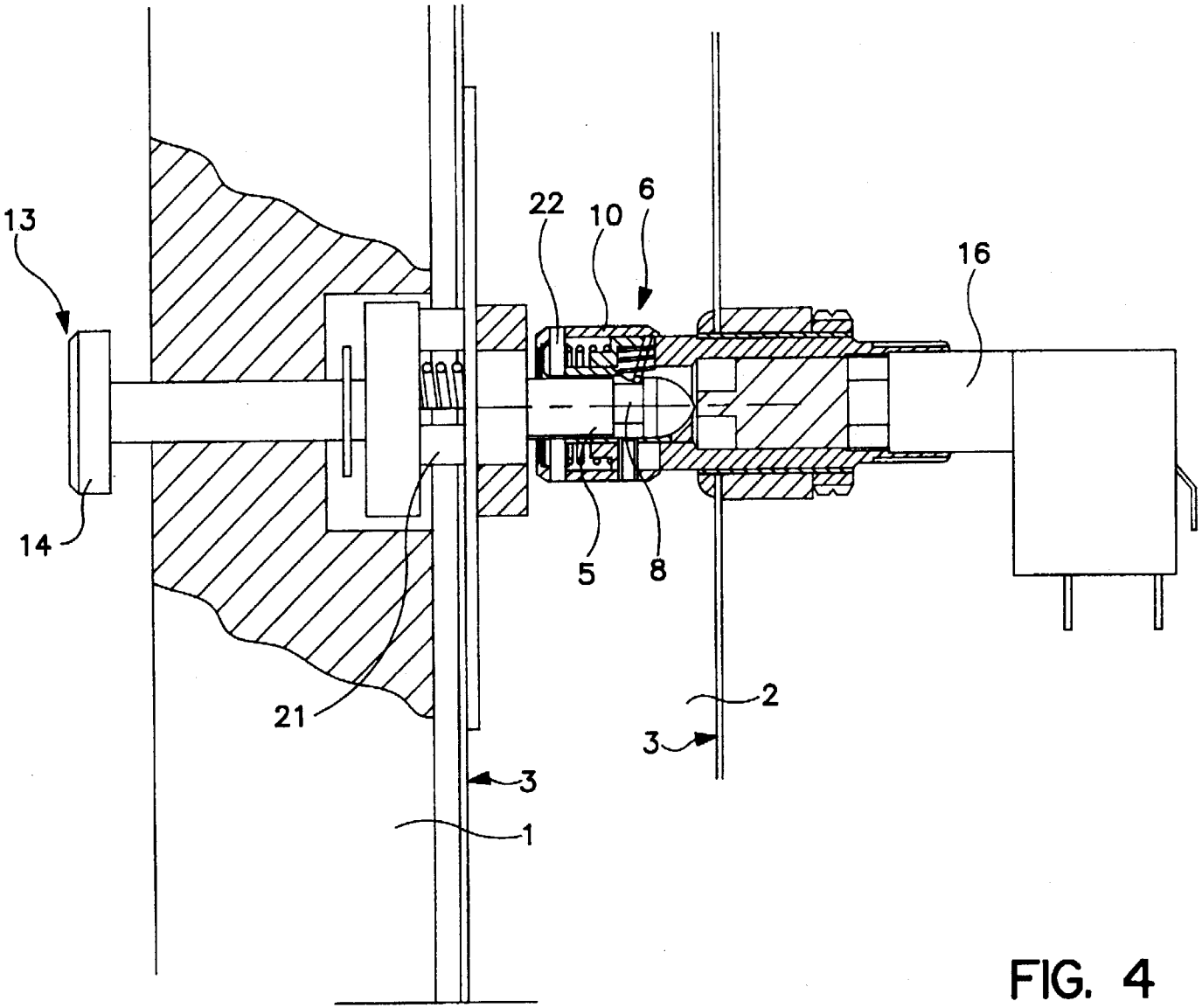
FIG. 4 is a side view in longitudinal cross-section of the locking device from FIG. 3 in a locked position.

The embodiment of the device shown in FIGS. 3 and 4 comprises the same members as the device of FIGS. 1 and 2 and these members are identified by the same reference numbers.

In this embodiment the female member 6 further comprises auxiliary locking means 22 such as balls that are spring-loaded radially towards the axis of the internal bore 7 of the female member 6. The auxiliary locking means 22 engage elastically in the groove 8 when the male rod 5 is in an intermediate pre-opening position shown in FIG. 5 in which the door 1 is slightly open and retained by said auxiliary means 22 engaged in the groove 8. The door 1 can then be opened by deliberately pulling on it to withdraw the auxiliary locking means 22 from the groove 8. The open position of FIG. 3 and the closed position of FIG. 4 are identical to those of the previous embodiment shown in FIGS. 1 and 2.

Figure 6:
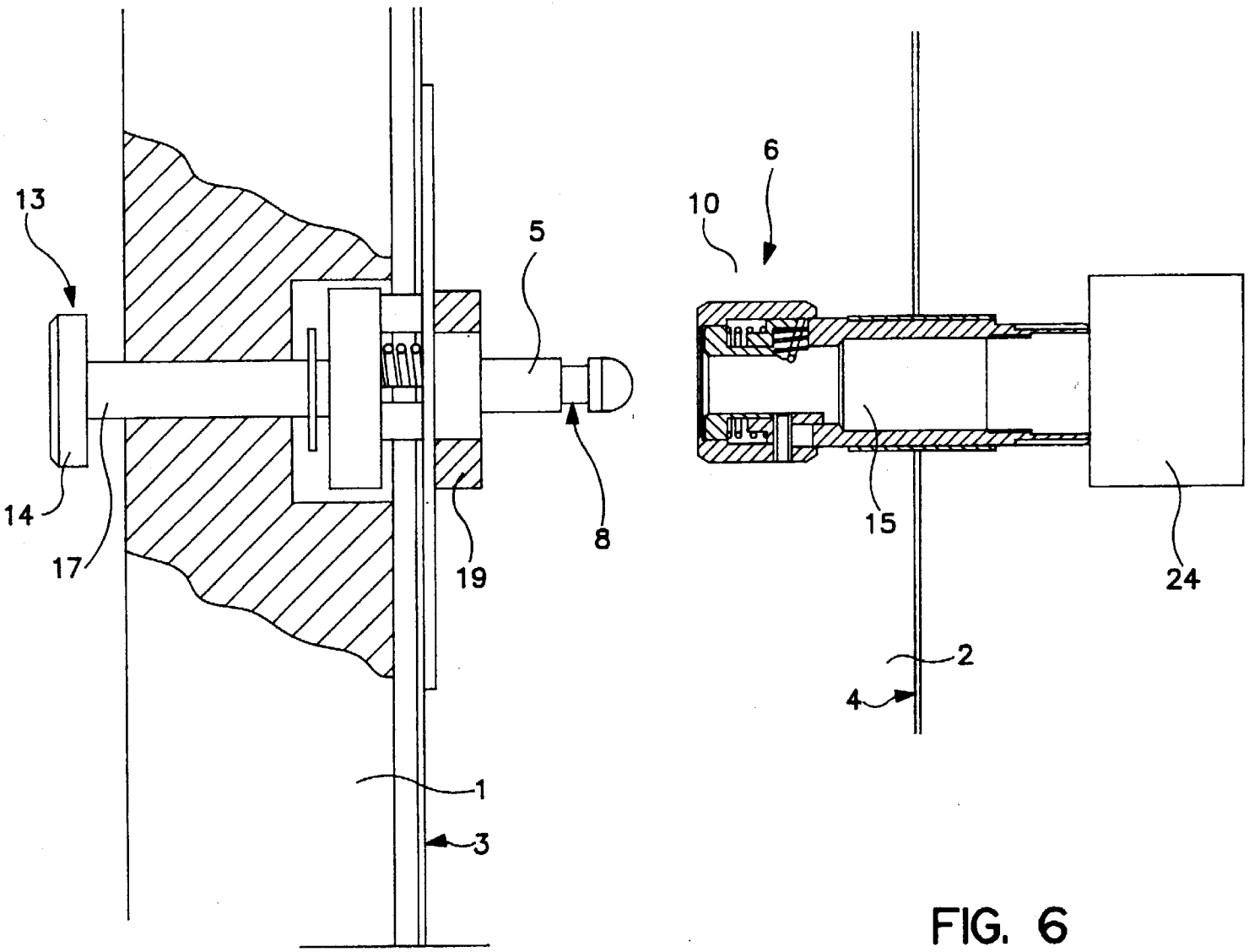
FIG. 6 is a side view in longitudinal cross-section of a further embodiment of a locking device in accordance with the invention shown in an open position.
Figure 7:
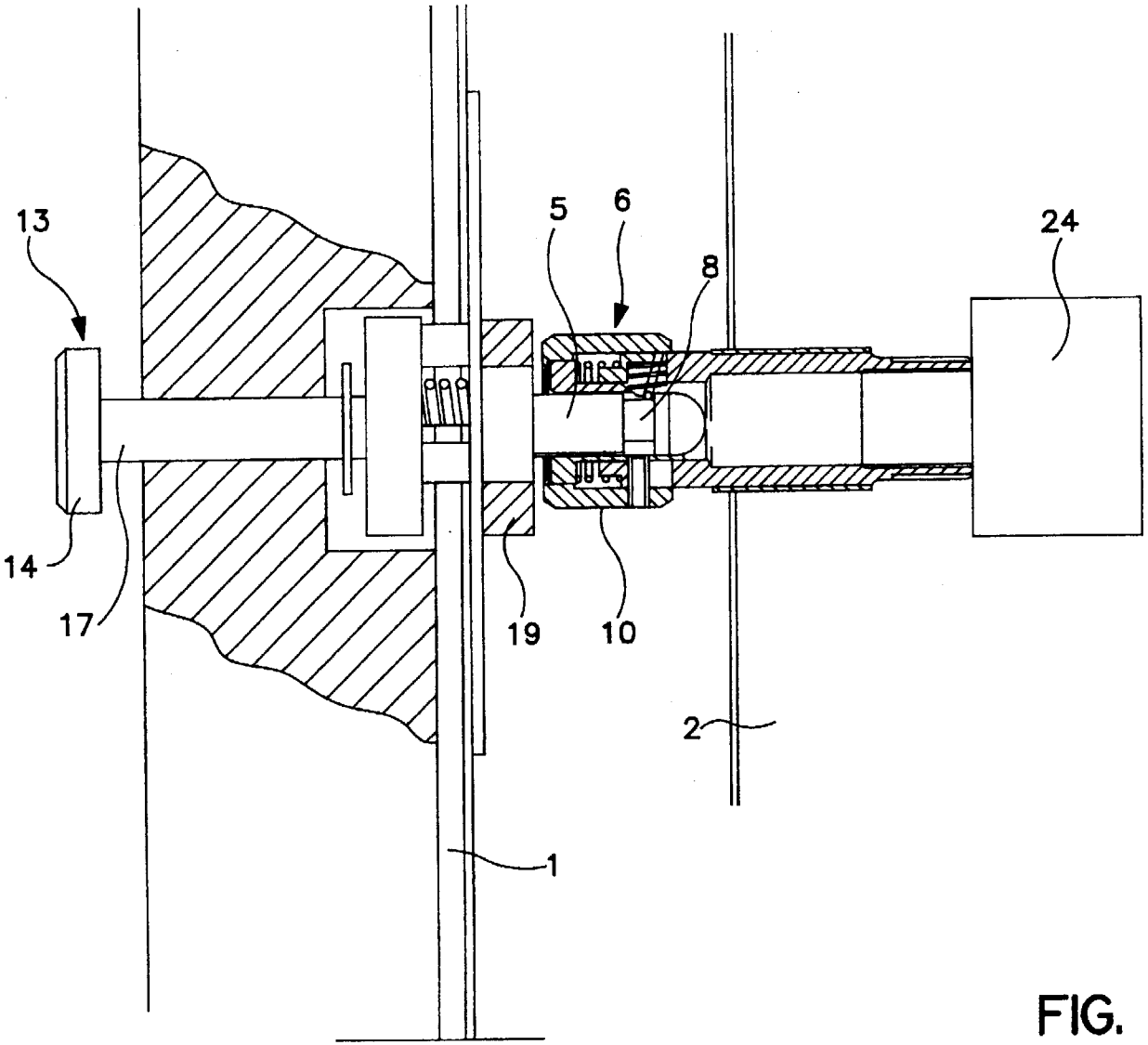
FIG. 7 is a side view in longitudinal cross-section of the device from FIG. 6 shown in a locked position.

The device shown in FIGS. 6 and 7 comprises the same members as the device of FIGS. 1 and 2, which are identified by the same reference numbers.

The members carried by the door 1 are identical.

This embodiment is distinguished by the fact that the female member 6 is slidably mounted on the muffle 2 and is moved axially by a motor or actuator 24. Accordingly, in the open position as shown in FIG. 6, the female member 6 projects slightly from the muffle 2. When the male rod 5 is inserted in the female member 6, the latter bears on the core 15 which operates a switch controlling the supply of power to the motor or actuator 24 which then pulls the female member 6 inwards, pulling simultaneously on the female member 6, the male rod 5 and the door 1, to increase the force with which the door 1 is pressed against the muffle 2, as shown in FIG. 7. Manual clutch means are provided for decoupling the female member 6 from the motor or actuator 24.

It is now explained how the actuator would be attached to either the male or female member so as to pull them. In FIG. 6, the female member 6 can slide axially in the oven muffle 2. The sliding axial movement of the female member 6 is produced by the actuator 24 which pulls the female member 6 towards the inside of the muffle 2 (to the right side of FIG. 6). One of ordinary skill in the art would understand how to pull the female member 6 with an actuator 24, where the actuator 24 mechanically joins the female member 6 and the muffle wall 4.

In the embodiments shown, the male rod 5 and the female member 6 can be either solid or hollow. In the latter case, the male rod 5 and the female member 6 each have an axial bore through them connected to respective pipes to allow fluid to flow between the muffle 2 and the oven door 1.

Figure 5:
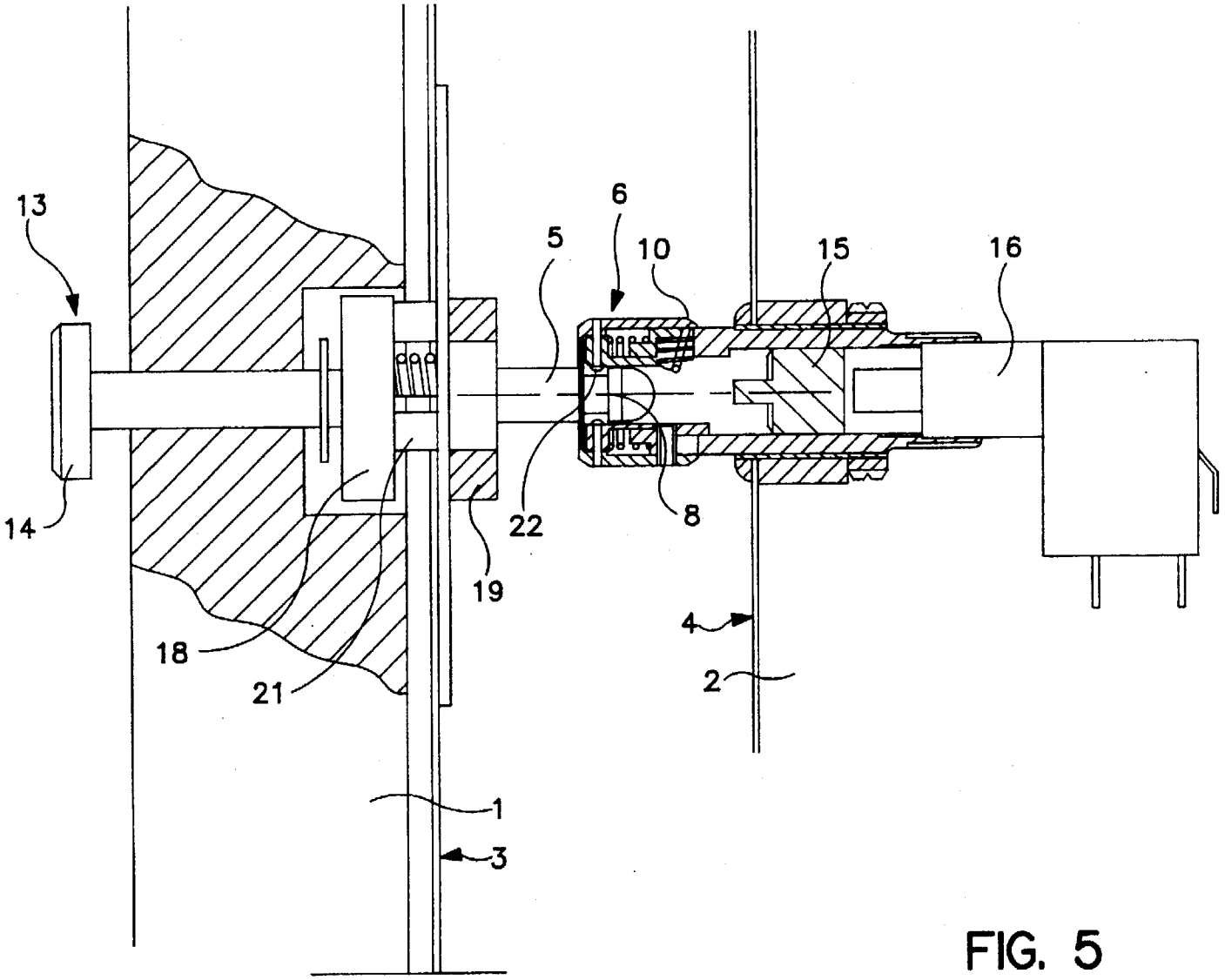
FIG. 5 is a side view in longitudinal cross-section of the device from FIG. 3 in a pre-opening position.

In the embodiments, the door is locked simply by pushing the door 1 towards the muffle 2 to engage the male rod 5 in the bottom of the female member 6 until the locking members 9 enter the groove 8. Unlocking is effected by pushing the push-button 13, the internal thrust ring 13 of which presses against the unlocking ring 10 and pushes it towards the muffle 2. This movement of the unlocking ring 10 withdraws the locking members 9 from the internal bore 7 and the groove 8 with the result that the door 1 can be pulled away from the muffle 2. In the embodiment of FIGS. 3–5, the door is opened in two stages: when unlocked, the door 1 moves back until the auxiliary locking means 22 enter the groove 8 and hold the door in the pre-opening position; pulling on the door 1 then opens it by forcibly extracting the auxiliary locking means 22 from the groove 8 to release the door.

Figure 8:
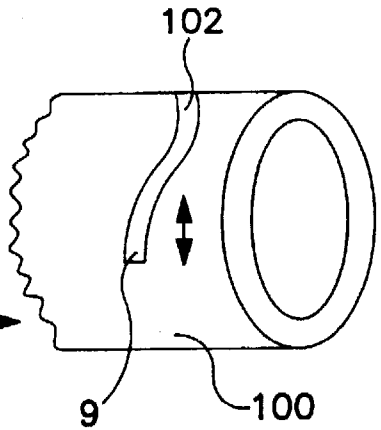
FIG. 8 shows a portion of the cylindrical outer casing of an exemplary female member in accordance with the present invention.
Figure 9:
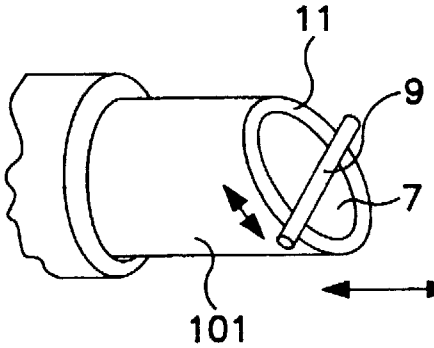
FIG. 9 is a perspective view of the top of the inner cylindrical piece of an exemplary unlocking ring in accordance with the present invention.
Figure 10:
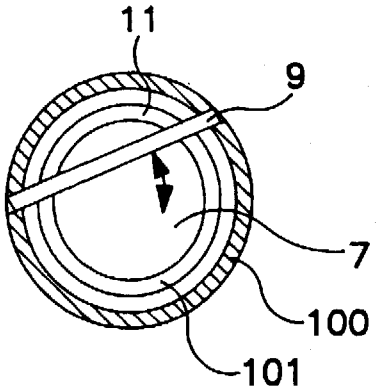
FIG. 10 is a view from the right side of FIG. 1.

FIGS. 8–10 contain similar elements as have been described above with respect to FIG. 1. These elements are labeled identically and their description is omitted for brevity. FIG. 8 shows a portion of the cylindrical outer casing of the female member 6. FIG. 9 shows a perspective view of the top portion of the inner cylindrical piece of the unlocking ring 10. FIG. 10 is a view from the right side of FIG. 1, cut along the line 10—10, showing the outer casing of the female member 6 and the inner piece of the unlocking ring 10 with the locking member 9.

FIG. 9 shows the extreme edge of the inner piece 101, forming an inclined ramp 11 on which the locking member 9 can slide. The locking member 9 is a transverse rod. The inner piece 101 slides in the outer casing 100. In FIG. 8, the ends of the transverse rod forming the locking member 9 are engaged in an inclined slot 102 in the peripheral wall of the outer casing 100. Ramp 11 and slot 102 are inclined in opposite directions.

These features of the present invention result in safety and reliability advantages when the device is used to lock an oven door. When an oven is in use, the inside of the oven muffle becomes hot. Due to steam pressure inside the oven, the oven muffle often is at a higher pressure than the outside atmospheric pressure. The present invention ensures that the pressure inside the oven will not unlock the oven door. This results in increased safety and reliability of the oven.

In the present invention (see e.g., FIGS. 1 and 2), the locking member (transverse rod) 9 is pulled to the left by the male rod 5 if the door is pushed by steam pressure in the oven. But the locking member 9 cannot slide radially outwards because it is guided in the inclined slot 102 in the outer casing 100 of the female member 6. In order to move the locking member 9 radially outwards, it is desired to push the locking member 9 axially towards the inside of the female member 6 (towards the right side in the figure).

It is because the claimed invention contains a cylindrically shaped unlocking ring which slides axially on the female member that the oven door remains locked, even when the pressure inside the oven is much greater than the outside atmospheric pressure. This results in a much safer and more reliable oven.

The present invention is not limited to the embodiments explicitly described but includes various variants and generalizations thereof within the scope of the following claims.

What is claimed:

1. A locking oven comprising:

an oven door having an oven door contact side, an oven muffle having an oven muffle contact side, and a locking device for locking the oven door when the oven door contact side is pressed against the oven muffle contact side, wherein:

a male rod projects perpendicularly from the respective contact side of one of the group consisting of the oven door and the oven muffle, a female member with an internal bore is fitted to the other of the group consisting of said oven door and said oven muffle, the female member having a base portion, said male rod and said female member are shaped and disposed so that said male rod enters said female member when said oven door is pressed against the opening of said oven muffle to close it, said male rod includes at least one intermediate annular groove, said female member includes a locking member movable radially between a locking position in which said locking member enters said internal bore and into said groove of said male rod to prevent axial sliding of said male rod and an unlocking position in which said locking member is withdrawn from said internal bore and from said groove to allow axial sliding of said male rod, said female member includes a cylindrically shaped unlocking ring sliding axially relative to the base portion and shaped to move said locking member radially between said locking position and said unlocking position when it is moved axially, spring means urge said unlocking ring towards its locking position in which said locking member is in said locking position, and a push-button is provided on the one of the group consisting of the oven door and the oven muffle and is shaped to move said unlocking ring in translation on said female member to bring about unlocking.

2. A locking oven according to claim 1, wherein said male rod is fixed to said oven door and said push-button is slidably mounted on said oven door.

3. A locking oven according to claim 2, wherein said female member has an internal bore and comprises an electric switch device in said internal bore adapted to be operated by said male rod to close an electric contact when said male rod is moved to said locking position.

4. A locking oven according to claim 1, wherein said female member comprises auxiliary locking means adapted to be elastically engaged in said groove when said male rod is in an intermediate pre-opening position in which said oven door is slightly open and retained by said auxiliary locking means engaged in said groove, said oven door being thereafter openable by deliberately pulling on said oven door to withdraw said auxiliary locking means from said groove.

5. A locking oven according to claim 4, wherein said auxiliary locking means comprises balls being spring-loaded towards the axis of said female member.

6. A locking oven according to claim 1, wherein a spring urges said push-button away from said unlocking ring.

7. A locking oven according to claim 6, wherein said push-button comprises a head joined by a rod to a bearing plate joined to an internal thrust ring by three columns slidably mounted in said oven door around said male rod, said internal thrust ring bearing on said unlocking ring.

8. A locking oven according to claim 1, wherein one of a motor and an actuator is adapted to pull on said female member which is slidably mounted on said oven muffle.

9. A locking oven according to claim 1, wherein said unlocking member is a rod moving along a ramp to engage said groove.

* * * * *